US010056201B2

(12) United States Patent
Miyaoka

(10) Patent No.: US 10,056,201 B2
(45) Date of Patent: Aug. 21, 2018

(54) PUSH SWITCH

(71) Applicant: Panasonic Intellectual Property Management Co., Ltd., Osaka (JP)

(72) Inventor: Takeshi Miyaoka, Fukui (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 15/478,292

(22) Filed: Apr. 4, 2017

(65) Prior Publication Data

US 2017/0309419 A1 Oct. 26, 2017

(30) Foreign Application Priority Data

Apr. 25, 2016 (JP) ..... 2016-087173

(51) Int. Cl.
*H01H 13/02* (2006.01)
*H01H 13/14* (2006.01)
*H01H 13/04* (2006.01)

(52) U.S. Cl.
CPC ..... *H01H 13/14* (2013.01); *H01H 13/023* (2013.01); *H01H 13/04* (2013.01); *H01H 2013/026* (2013.01)

(58) Field of Classification Search
CPC ..... H01H 13/023; H01H 2221/026; H01H 2221/028; H01H 2221/058; H01H 2221/06
See application file for complete search history.

(56) References Cited

U.S. PATENT DOCUMENTS 3,639,745 A * 2/1972 Shiki ..... H02B 1/048 174/58
5,581,251 A * 12/1996 McRight ..... H01H 13/023 200/314
7,989,722 B2 * 8/2011 McCurdy ..... H01H 9/182 200/314
9,466,890 B2 * 10/2016 Hanaoka ..... H01Q 23/00
2009/0114514 A1 5/2009 Uenomachi et al.

FOREIGN PATENT DOCUMENTS

JP 2009-117038 5/2009

* cited by examiner

*Primary Examiner* — Felix O Figueroa
(74) *Attorney, Agent, or Firm* — Greenblum & Bernstein, P.L.C.

(57) ABSTRACT

A push switch includes a casing, an operation body movable into and out of the casing, and a switch element operable with the movement of the operation body into and out of the casing. The casing includes a first outer peripheral wall, a first inner peripheral wall, a first guide provided to the first outer peripheral wall, and a second guide provided to the first inner peripheral wall. The operation body includes a second outer peripheral wall, a second inner peripheral wall, a first engagement portion provided to the second outer peripheral wall and slidably engaged with the first guide, and a second engagement portion provided to the second inner peripheral wall and slidably engaged with the second guide. A clearance between the second guide and the second engagement portion is smaller than a clearance between the first guide and the first engagement portion.

9 Claims, 8 Drawing Sheets

PUSH SWITCH

BACKGROUND

1. Technical Field

The present disclosure relates to the configuration of a push switch equipped in various electronic devices.

2. Description of the Related Art

Switches used in electronic devices such as car audio devices include push switches in which the display part on the front of the operation button is illuminated from the back at night or in dark places. These push switches often include a light-shielding plate (light-shielding wall). This plate (wall) prevents the light emitted from a light source to illuminate the letters on the display part and the light emitted from another light source to illuminate the indicator from leaking into respective regions individually illuminated by the lights.

Japanese Unexamined Patent Publication No. 2009-117038 (hereinafter, Patent Literature 1) discloses an illuminated switch device that allows the user to smoothly operate the operation button and causes no or little light leakage. This illuminated switch device includes a casing and a cylindrical operation body (operation button). The operation body is provided with a light-shielding wall therein. One of the casing and the operation body is equipped with vertical guide rails and the other is provided with vertical grooves. The guide rails and the grooves are engaged with each other to guide the operation body with respect to the casing, so that the user can smoothly operate the operation body.

In this illuminated switch device, the guide rails are located at both ends of the light-shielding wall that are extended toward the outside of the cylindrical operation body. The switch device further includes two light sources. With this configuration, the light coming from one of the light sources and traveling into the gap between the casing and the operation body is prevented from leaking into the region to be illuminated by the other light source.

SUMMARY

The present disclosure provides a push switch that provides smooth operation of the operation body.

The push switch according to the present disclosure includes a casing, an operation body movable into and out of the casing, and a switch element operable with the movement of the operation body into and out of the casing. The casing includes a first outer peripheral wall, a first inner peripheral wall located further inside than the first outer peripheral wall, a first guide, and a second guide. The first guide is provided to the first outer peripheral wall, and the second guide is provided to the first inner peripheral wall. The operation body includes a second outer peripheral wall, a second inner peripheral wall located further inside than the second outer peripheral wall, a first engagement portion, and a second engagement portion. The first engagement portion is provided to the second outer peripheral wall and is slidably engaged with the first guide. The second engagement portion is provided to the second inner peripheral wall and is slidably engaged with the second guide. The clearance between the second guide and the second engagement portion is smaller than the clearance between the first guide and the first engagement portion.

In this configuration, the second guide and the second engagement portion are located very much inside the push switch. This makes the switch unsusceptible to dimensional change even when the switch including the operation body and the casing is large-sized. As a result, wobbling is suppressed between the operation body and the casing during the operation of the operation body, allowing the user to smoothly operate the operation body.

DETAILED DESCRIPTION OF PREFERRED EMBODIMENT

Figure 1:
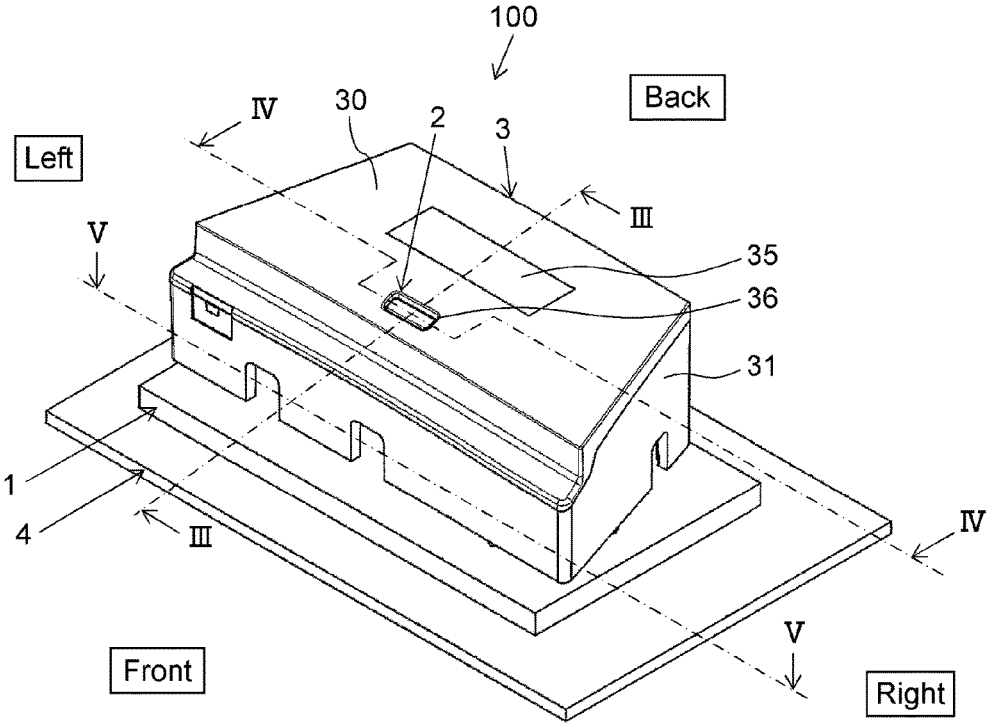
FIG. 1 is a perspective view of a push switch according to an exemplary embodiment of the present disclosure.

Prior to describing an exemplary embodiment of the present disclosure, problems associated with the illuminated switch device disclosed in Patent Literature 1 will now be described in brief. One of the problems is that when large in size, the switch device may have large dimensional change in components with time or due to ambient conditions such as temperature and humidity. Another problem is as follows. The guide rails and the grooves are respectively provided to the outer peripheral wall of the casing and the external cylindrical portion of the operation body. When two or more guide rails are formed, the spacing between them is large, causing the switch device to be more susceptible to dimensional change. This influence could be reduced by providing large clearances between the guide rails and the grooves. However, large clearances may cause wobbling between the casing and the operation body when the user operates the operation body. As a result, the user cannot operate it smoothly.

The exemplary embodiment of the present disclosure will now be described with reference to the drawings. In these drawings, the same or equivalent components are denoted by the same reference numerals and may not be described repeatedly. All drawings illustrate only some components appropriate to describe the present disclosure and may omit the other components. Furthermore, the present disclosure is not limited to the following exemplary embodiment.

A push switch according to the present exemplary embodiment will now be described with reference to FIGS. 1 to 8.

Configuration of the Push Switch

Figure 2:
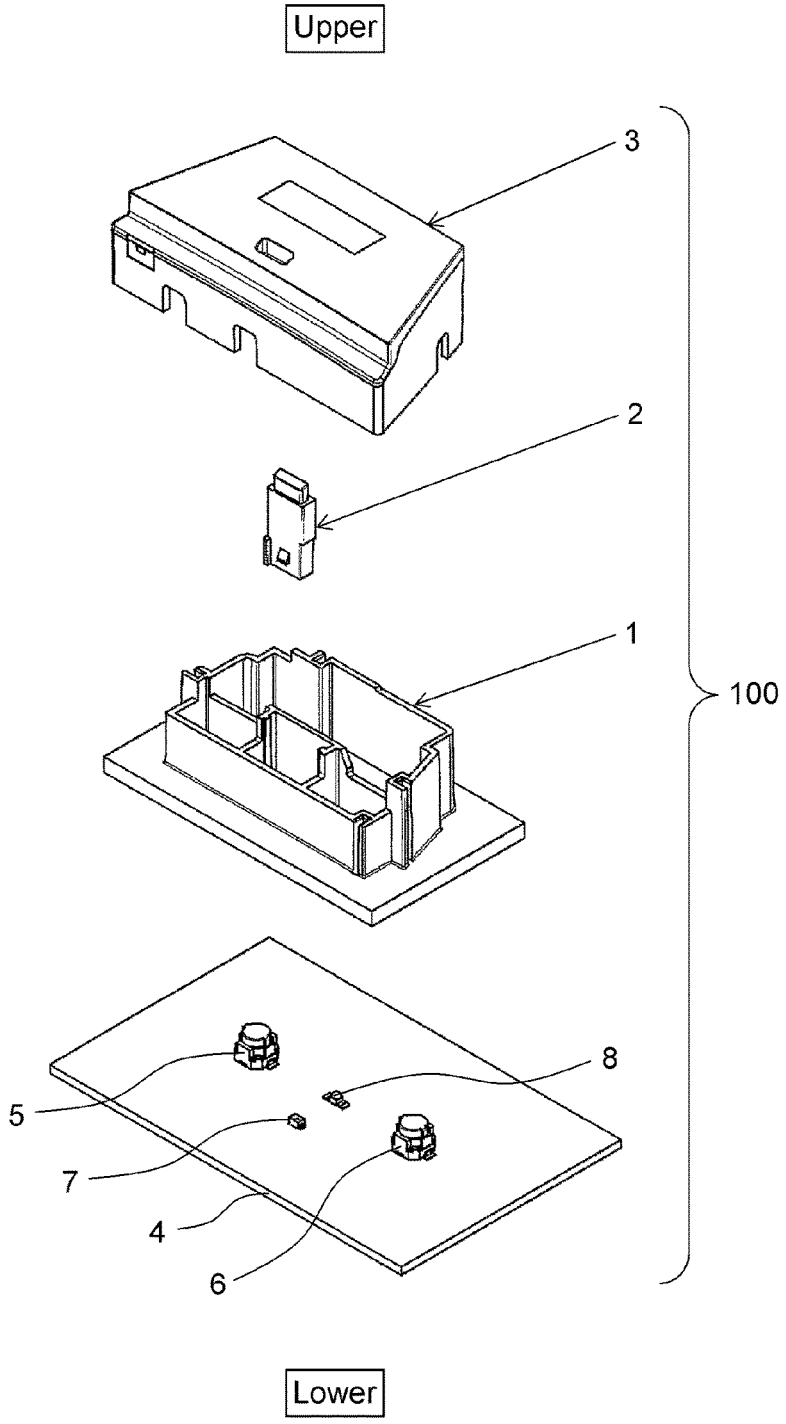
FIG. 2 is an exploded perspective view of the push switch shown in FIG. 1.

FIG. 1 is a schematic perspective view of push switch 100 according to the present exemplary embodiment. FIG. 2 is an exploded perspective view of switch 100.

Figure 3:
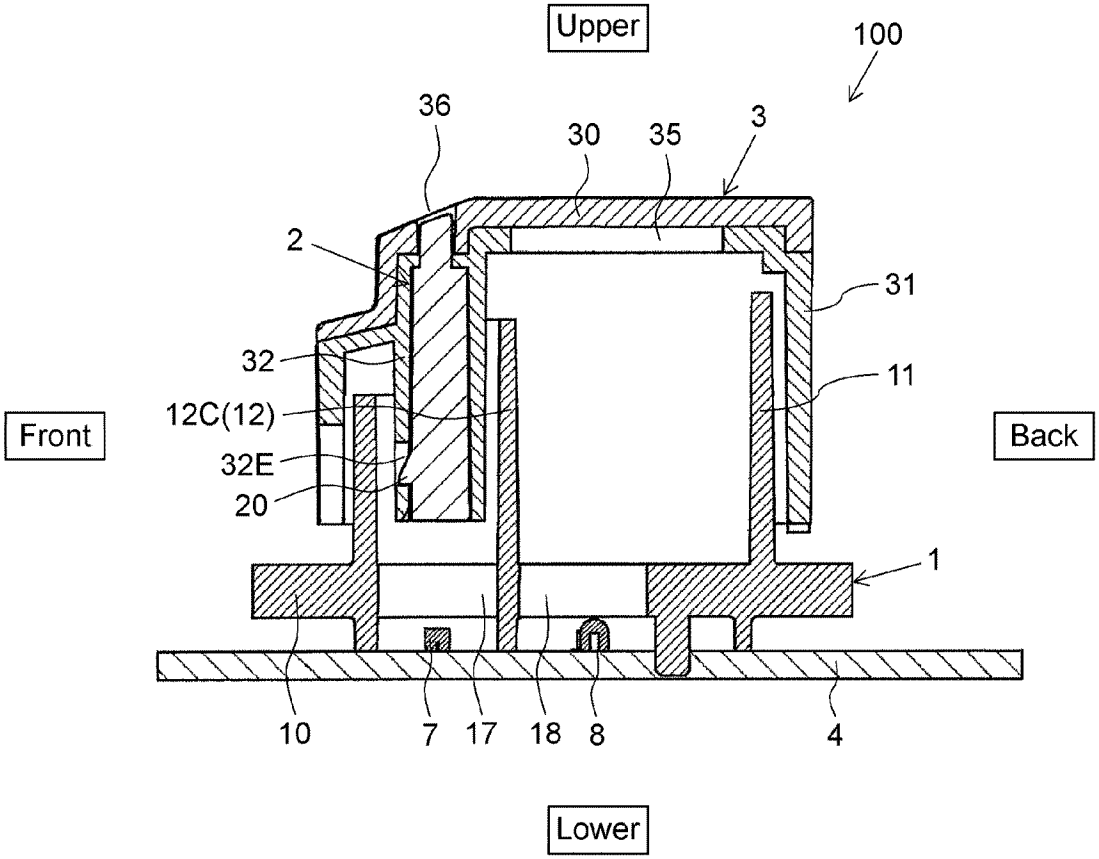
FIG. 3 is a vertical sectional view of the push switch shown in FIG. 1 along the short side of the push switch.
Figure 4:
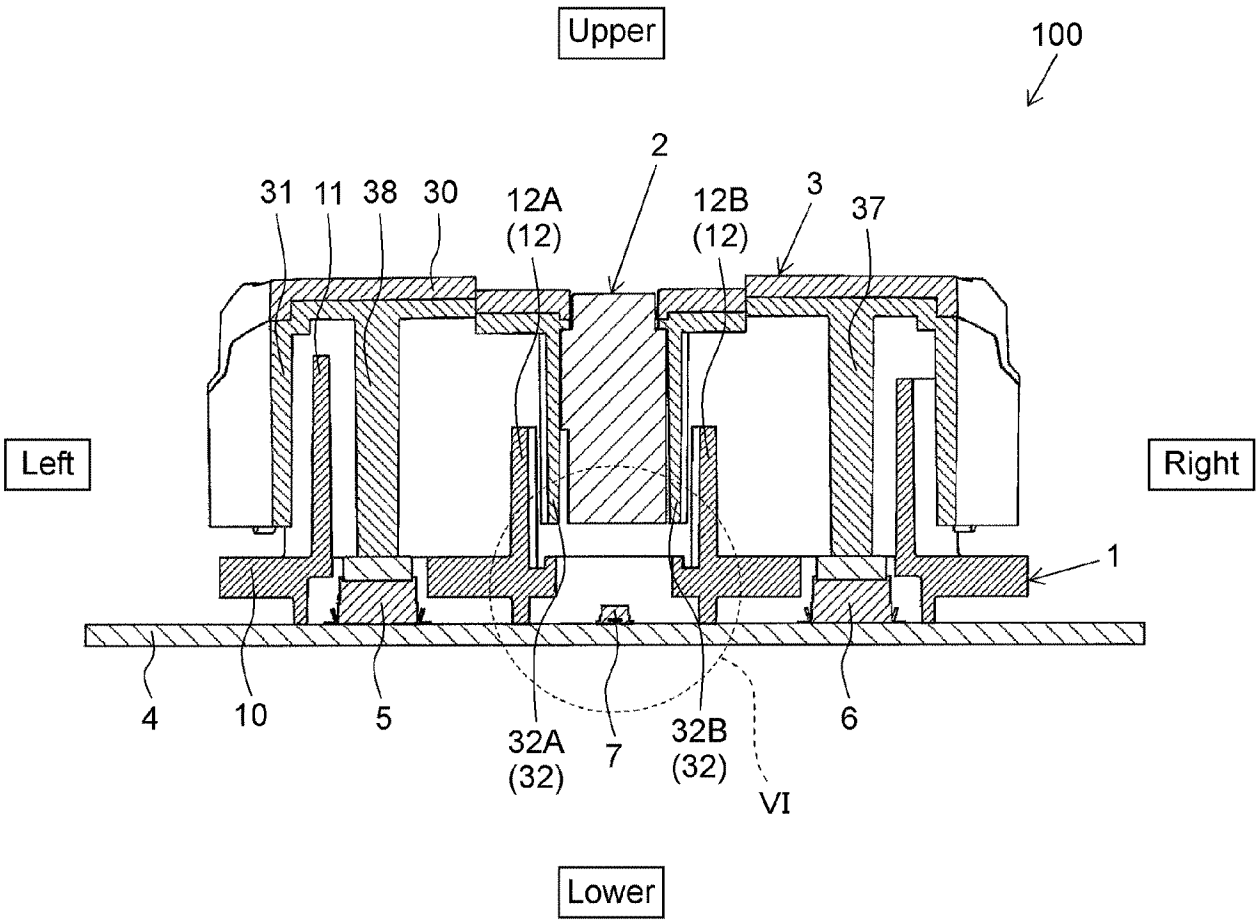
FIG. 4 is a vertical sectional view of the push switch shown in FIG. 1 along the long side of the push switch.
Figure 5:
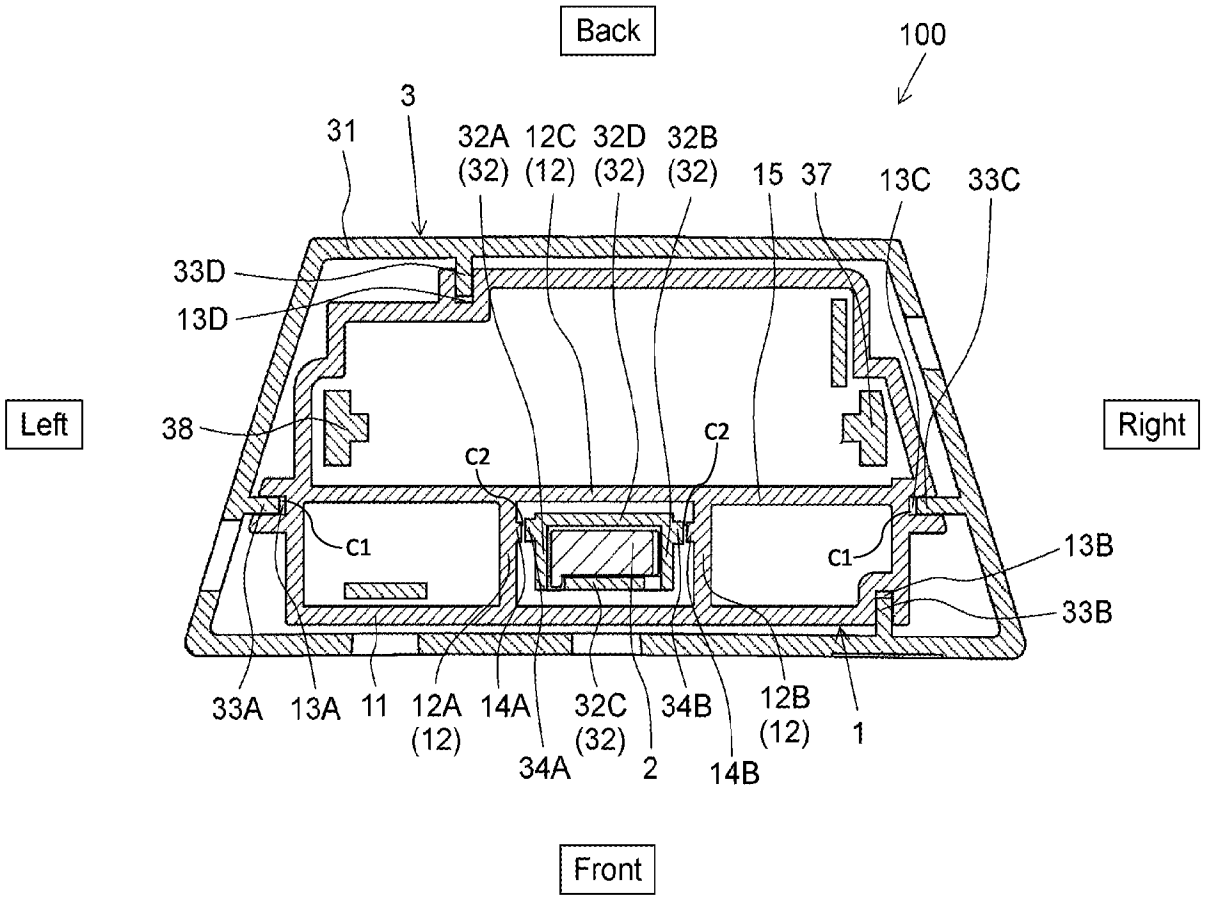
FIG. 5 is a horizontal sectional view of the push switch shown in FIG. 1.
Figure 6:
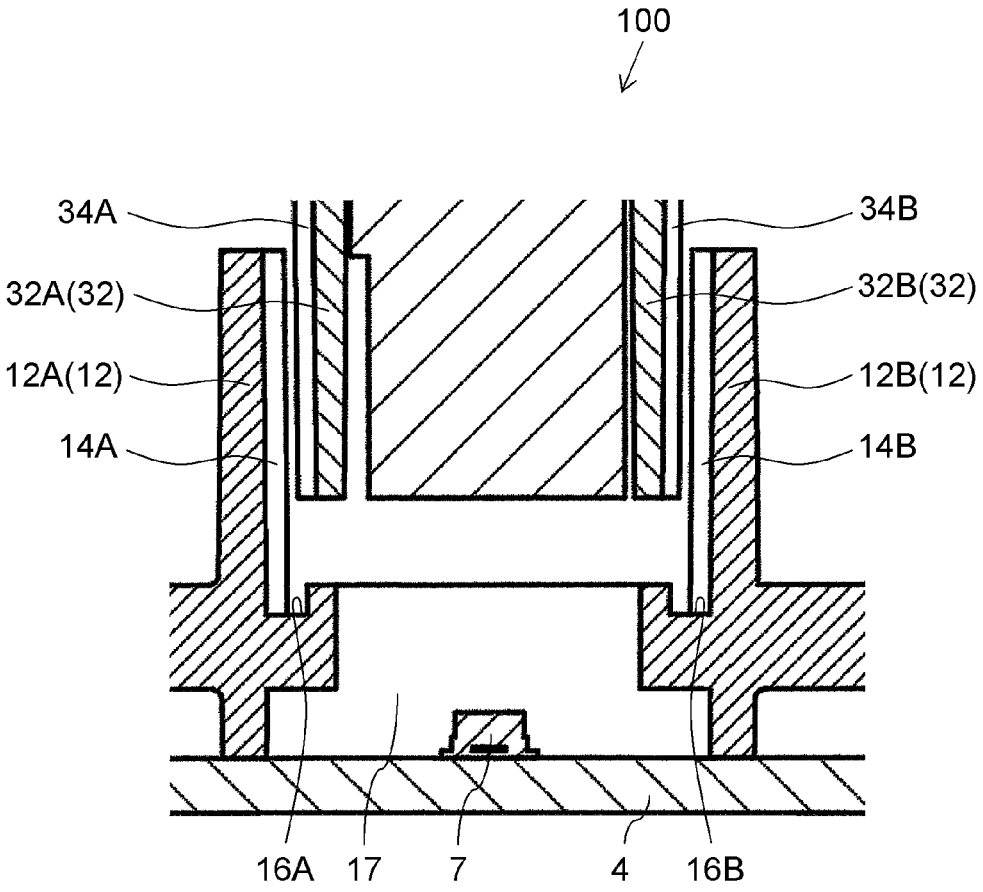
FIG. 6 is an enlarged view of a region defined by VI in the push switch shown in FIG. 4.

FIGS. 3, 4, and 5 are sectional views of switch 100 taken along lines III-III, IV-IV, and V-V, respectively, shown in FIG. 1. FIG. 6 is an enlarged view of a region defined by VI in push switch 100 shown in FIG. 4.

Figure 7:
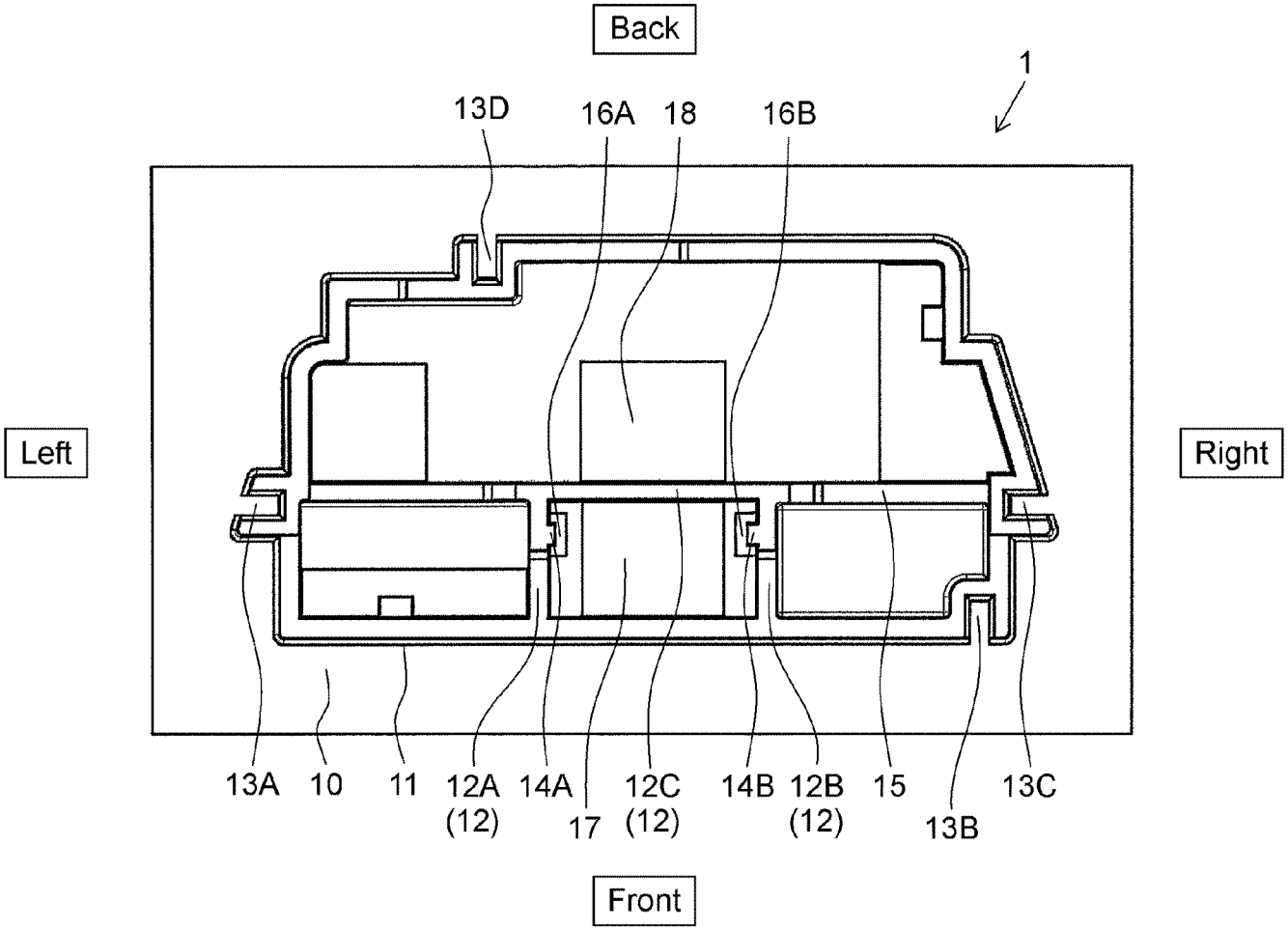
FIG. 7 is a top view of the casing of the push switch shown in FIG. 1.
Figure 8:
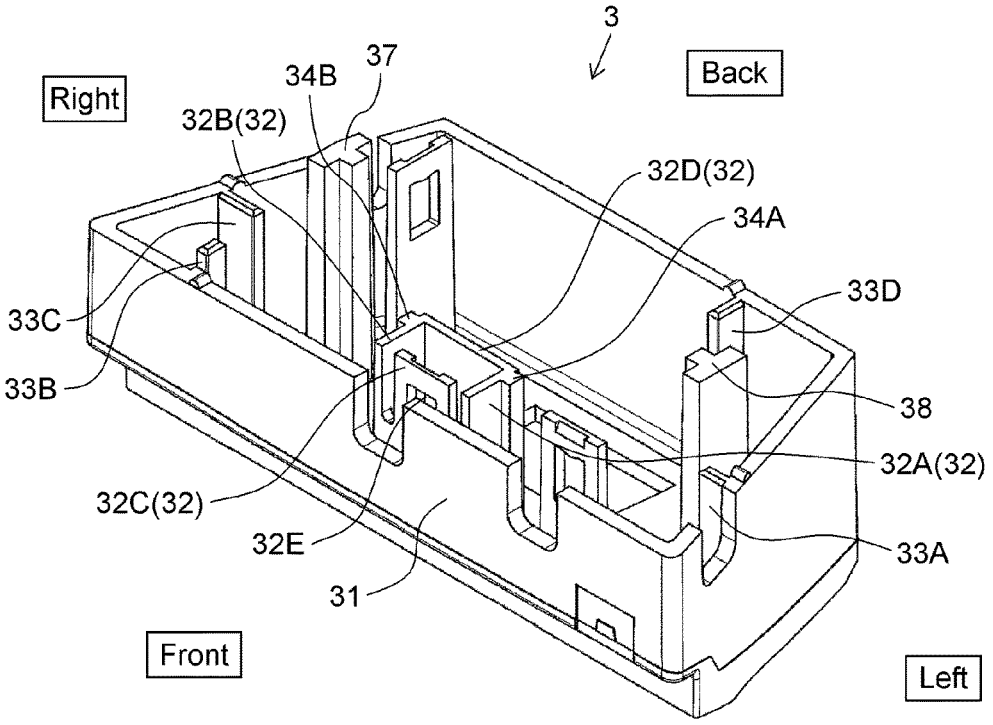
FIG. 8 is a perspective view an operation body of the push switch shown in FIG. 1 when seen from the back.

FIG. 7 is a top view of casing 1 of switch 100, and FIG. 8 is a perspective view of operation body 3 in switch 100 when seen from the back.

For easier understanding of the geometry of switch 100, FIGS. 1 to 8 define the top, bottom, front, back, left, and right of switch 100; however, these directions do not necessarily coincide with the orientation of push switch 100 in use.

As shown in FIGS. 1 and 2, push switch 100 includes casing 1, operation body 3 movable into and out of casing 1, and switch elements 5 and 6 operable by moving operation body 3 into and out of casing 1. As shown in FIGS. 5 and 7, casing 1 includes first outer peripheral wall 11, first inner peripheral wall 12 located further inside than first outer peripheral wall 11, first guides 13A to 13D, and second guides 14A and 14B. First guides 13A to 13D are provided to first outer peripheral wall 11, and second guides 14A and 14B are provided to first inner peripheral wall 12. As shown in FIGS. 5 and 8, operation body 3 includes second outer peripheral wall 31, second inner peripheral wall 32 located further inside than second outer peripheral wall 31, first engagement portions 33A to 33D, and second engagement portions 34A and 34B. First engagement portions 33A to 33D are provided to second outer peripheral wall 31 and are slidably engaged with first guides 13A to 13D, respectively. Second engagement portions 34A and 34B are provided to second inner peripheral wall 32 and are slidably engaged with second guides 14A and 14B, respectively.

Push switch 100 further includes light guide element 2, substrate 4, first light source 7, and second light source 8. The light emission of first light source 7 is controlled by pushing operation body 3 to turn on or off switch elements 5 and 6.

The light emission of second light source 8 is controlled by turning on and off an unillustrated switch element in the present exemplary embodiment, but may alternatively be controlled by turning on and off switch elements 5 and 6. First light source 7 and second light source 8 may emit light of either the same or different colors from each other. These light sources 7 and 8 may include LEDs or light bulbs.

Each component of switch 100 will now be described in detail. As shown in FIGS. 5 and 7, casing 1 includes base 10, first outer peripheral wall 11, first inner peripheral wall 12, first guides 13A to 13D, and second guides 14A and 14B. As shown in FIGS. 3 and 4, base 10 serves a bottom of casing 1. First outer peripheral wall 11 and first inner peripheral wall 12 stand on the upper side of base 10.

Substrate 4 is laid under base 10. Substrate 4 is mounted with switch elements 5 and 6, first light source 7, and second light source 8 at appropriate locations. Casing 1 is made of either a light-blocking colored synthetic resin or a synthetic resin which can light-block as a material.

As shown in FIGS. 5 and 7, when switch 100 is seen from above, first outer peripheral wall 11 is an approximate rectangle of greater length in the horizontal (right-to-left) direction than width in the front-to-back direction. First outer peripheral wall 11 is provided with vertical, groove-shaped first guides 13A to 13D, respectively on the four outer sides of first outer peripheral wall 11. First guides 13A to 13D are slidably engaged with first engagement portions 33A to 33D, respectively, of operation body 3, which will be described later.

First guides 13A to 13D are grooves in the present exemplary embodiment, but may alternatively be ribs. Still alternatively, some of first guides 13A to 13D may be grooves and the other may be ribs. Note that the four first guides are not necessarily provided, and one first guide, two, three, five, or more first guides can be acceptable.

As shown in FIGS. 4 and 7, first inner peripheral wall 12 is located further inside than first outer peripheral wall 11. First inner peripheral wall 12 includes inner walls 12A to 12C. Inner walls 12A and 12B extend rearward from the inner surface of the front side of first outer peripheral wall 11. Inner wall 12C extends in the longitudinal direction of first outer peripheral wall 11 to connect the rear ends of inner walls 12A and 12B. Inner wall 12C is a part of partition wall 15, which partitions the space inside first outer peripheral wall 11 into a front portion and a rear portion.

Second guides 14A and 14B are located on the opposing inner sides of inner walls 12A and 12B, respectively, in such a manner that second guides 14A and 14B are arranged in the longitudinal direction (horizontal direction) of casing 1. The phrase "arranged in the longitudinal direction of casing 1" means that two second guides 14A and 14B are arranged on the pair of inner walls 12A and 12B, which are the short sides of first inner peripheral wall 12 when seen from the top or bottom of push switch 100. More specifically, second guides 14A and 14B can be either aligned or not aligned when seen from the right- or left-hand side of push switch 100. FIGS. 5 and 7 show a state in which second guides 14A and 14B are aligned with each other when seen from the right- or left-hand side of push switch 100.

Second guides 14A and 14B are vertical ribs to be slidably engaged with second engagement portions 34A and 34B, respectively, of operation body 3 as will be described later. In other words, second guides 14A and 14B extend from base 10 in the direction in which operation body 3 moves.

As shown in FIGS. 6 and 7, base 10 is provided on the upper side with recesses 16A and 16B around second guides 14A and 14B, respectively. When casing 1 is seen from above, recesses 16A and 16B are U-shaped to surround second guides 14A and 14B, respectively.

Second guides 14A and 14B are ribs in the present exemplary embodiment, but may alternatively be grooves. Still alternatively, one of second guides 14A and 14B may be a rib and the other maybe a groove.

The number of the second guides in the present exemplary embodiment is two, but may be at least one. For example, the number may be four or six. In these cases, two or more second guides may be provided to each of inner walls 12A and 12B, or to each of inner walls 12A, 12B and 12C, and the portion of first outer peripheral wall 11 that opposes inner wall 12C. When the second guides are provided to inner wall 12C and inside first outer peripheral wall 11, the second engagement portions, which will be described later, can be provided to inner walls 32D and 32C.

Recesses 16A and 16B, which are U-shaped in the present exemplary embodiment, may have any shape view from above, such as an I-shape or a T-shape.

Base 10 is perforated with through-hole 17 in the region surrounded by first inner peripheral wall 12 so as to expose first light source 7 as shown in FIG. 7. Base 10 is also perforated with through-hole 18 in the (rear side) region opposite to through-hole 17 across inner wall 12C (partition wall 15) so as to expose second light source 8.

Operation body 3 includes operation part 30, second outer peripheral wall 31, second inner peripheral wall 32, first engagement portions 33A to 33D, second engagement portions 34A and 34B, display design part 35, and indicator 36 as shown in FIGS. 3 to 5 and 8. Operation part 30 is approximately trapezoidal when push switch 100 is seen from above. The upper (front) side of operation part 30 is provided with indicator 36 and display design part 35.

Indicator 36 is provided with a through-hole into which the upper end of light guide element 2 is inserted. Light guide element 2 is fitted in the space defined by second inner peripheral wall 32. First light source 7 is located opposed to the end of light guide element 2.

Display design part 35 is a region to display pictures and letters by the light emitted from second light source 8 and is provided with, for example, a space or a translucent or opalescent synthetic resin. Thus, second light source 8 is housed in casing 1 and illuminates operation body 3 so as to penetrate operation body 3 with an emitting light, together with first light source 7.

The portion of operation part 30 that includes display design part 35 in operation body 3 is made, for example, from a translucent or opalescent light-transmitting synthetic resin. Meanwhile, the lower portion of operation part 30 that includes second outer peripheral wall 31 and second inner peripheral wall 32 is made, for example, from a light-blocking synthetic resin with a dark color such as black. Operation body 3 may be formed, for example, by two-color molding.

The bottom portions of operation part 30 that are opposed to switch elements 5 and 6 are provided with push portions 37 and 38, which push switch elements 5 and 6, respectively, when operation body 3 is operated. The number of the switch elements is two in the present exemplary embodiment, but may alternatively be one, three, or more.

Second outer peripheral wall 31 extends downward from the bottom periphery of operation part 30 in such a manner as to surround first outer peripheral wall 11 of casing 1. Second outer peripheral wall 31 is composed of four outer walls, and first engagement portions 33A to 33D extend vertically on the inner sides of the four outer walls. First engagement portions 33A to 33D are ribs, which slide with first guides 13A to 13D, respectively, of first outer peripheral wall 11. This enables operation body 3 to move smoothly vertically.

First engagement portions 33A to 33D are ribs in the present exemplary embodiment. Alternatively, first engagement portions 33A to 33D may be grooves if first guides 13A to 13D are ribs.

Second inner peripheral wall 32 is located further inside than second outer peripheral wall 31 and extends downward from the inner bottom of operation part 30. Second inner peripheral wall 32 is approximately rectangular when seen from the top or bottom of push switch 100, and is located further inside than first inner peripheral wall 12.

Second inner peripheral wall 32 includes inner walls 32A, 32B, 32C, and 32D. Inner walls 32A and 32B extend in the front-to-back direction and are opposed to each other in the right-to-left direction. Inner walls 32C and 32D extend in the horizontal (right-to-left) direction and are opposed to each other in the front-to-back direction. More specifically, inner wall 32A is located at the left, and inner wall 32B is located at the right. Inner wall 32C is located at the front, and inner wall 32D is located at the rear.

As shown in FIGS. 3 and 8, inner wall 32C is perforated with through-hole 32E at the lower portion. Light guide element 2 is fitted into the space defined by second inner peripheral wall 32. Light guide element 2 has claw 20, which is inserted into through-hole 32E so that light guide element 2 is fixed to second inner peripheral wall 32. Light guide element 2 is made from a transparent synthetic resin.

As shown in FIGS. 5 and 6, inner wall 32A includes, on the outer side, second engagement portion 34A so as to be opposed to second guide 14A of inner wall 12A. Similarly, inner wall 32B includes, on the outer side, second engagement portion 34B so as to be opposed to second guide 14B of inner wall 12B. Second engagement portions 34A and 34B may be either ribs or grooves. FIGS. 5 and 6 show an example in which second guides 14A and 14B are opposed to second engagement portions 34A and 34B, respectively, and all of them are ribs.

Second engagement portions 34A and 34B are located behind inner walls 32A and 32B, respectively, in the present exemplary embodiment. Alternatively, however, the locations of second engagement portions 34A and 34B are not limited to those. Second engagement portions 34A and 34B may be located, for example, in the center or in front of inner walls 32A and 32B.

It is possible to apply a lubricant agent such as grease onto at least one of second guides 14A and 14B and second engagement portions 34A and 34B. This facilitates sliding between second guide 14A and second engagement portion 34A and/or between second guide 14B and second engagement portion 34B.

Second guides 14A and 14B and second engagement portions 34A and 34B are located further inside push switch 100 than first guides 13A to 13D and first engagement portions 33A to 33D. As a result, second guides 14A and 14B and second engagement portions 34A and 34B are less susceptible to dimensional change with time or due to ambient conditions than first guides 13A to 13D and first engagement portions 33A to 33D.

As a result, the clearance C2 between second guide 14A and second engagement portion 34A and the clearance C2 between second guide 14B and second engagement portion 34B shown in FIG. 6 can be smaller than the clearances C1 between first guides 13A to 13D and first engagement portions 33A to 33D, respectively, shown in FIG. 5. With this configuration, wobbling is less likely between operation body 3 and casing 1 than in conventional push switches during the operation of operation body 3, allowing the user to smoothly operate operation body 3. This effect is maintained even when push switch 100 including operation body 3 and casing 1 is large-sized.

Operation and Effects of the Push Switch

The operation and effects of push switch 100 will now be described as follows.

When the user pushes operation body 3 of switch 100 down either directly or through an unillustrated actuator or other device, first engagement portions 33A to 33D slide with first guides 13A to 13D, respectively, whereas second engagement portions 34A and 34B slide with second guides 14A and 14B, respectively. As a result, operation body 3 moves downward.

As described above, the clearances between second guides 14A and 14B and second engagement portions 34A and 34B are smaller than the clearances between first guides 13A to 13D and first engagement portions 33A to 33D. As a result, wobbling is unlikely between operation body 3 and casing 1 during the operation of operation body 3, allowing the user to smoothly operate operation body 3.

If operation body 3 is operated with a relatively large force and tilted to the right or left, a large force is applied between second inner peripheral wall 32 and first inner peripheral wall 12. If the force causes deformation of second inner peripheral wall 32 and first inner peripheral wall 12, the deformation is confined to the clearances between first guides 13A to 13D and first engagement portions 33A to 33D. This prevents damage of second inner peripheral wall 32 and/or first inner peripheral wall 12.

At least one of second guides 14A and 14B and second engagement portions 34A and 34B is coated with a lubricant agent such as grease. This further facilitates the smooth operation of operation body 3.

As described above, base 10 is provided on the upper side with recesses 16A and 16B around second guides 14A and 14B, respectively. Therefore, if the applied lubricant agent travels downward during the vertical operation of operation body 3, the agent is retained in recesses 16A and 16B. This prevents the agent from flowing down through through-hole 17 and reaching substrate 4.

When pushed by push portions 37 and 38 of operation body 3, switch elements 5 and 6 are turned on, and first light source 7 emits light to illuminate indicator 36. In push switch 100, first light source 7 is surrounded by first inner peripheral wall 12 and is further surrounded by second inner peripheral wall 32. Thus, first light source 7 which illuminates operation body 3 so as to penetrate operation body 3 with an emitting light is housed in casing 1 and surrounded by first inner peripheral wall 12. As a result, the light emitted from first light source 7 into the space inside first inner peripheral wall 12 is prevented from leaking to the outside.

As described above, first light source 7 is opposed to the region surrounded by second inner peripheral wall 32, whereas second light source 8 is optically isolated from first light source 7 by first inner peripheral wall 12 or second inner peripheral wall 32. This prevents the light from first light source 7 and the light from second light source 8 from leaking into respective regions individually illuminated by the lights in push switch 100.

When the user releases the pushing force on operation body 3, operation body 3 is pushed upward to return to the original position by the upward return force of the pushed parts of switch elements 5 and 6 and/or the elastic action of an unillustrated elastic member.

From the above description, it is obvious for a person having ordinary skill in the art to make various modifications and other embodiments of the present disclosure. Therefore, the above description should be interpreted as an example used to teach the best mode of the present disclosure to a person having ordinary skill in the art. It is possible to substantially change the structure and/or functions of the present disclosure without deviating from the scope of the present disclosure. The components contained in the above embodiment can be properly combined to provide various other disclosures.

As described above, the push switch according to the present disclosure can be preferably used in electronic devices.

What is claimed is:

1. A push switch comprising:

a casing;

an operation body movable into and out of the casing; and a switch element operable with movement of the operation body into and out of the casing, wherein the casing includes:

a first outer peripheral wall;

a pair of first inner peripheral walls located further inside of the casing than the first outer peripheral wall, the pair of first inner peripheral walls being opposite each other and including inner sides facing each other;

a first guide provided to an outer side of the first outer peripheral wall; and a second guide provided to at least one of the inner sides of the pair of first inner peripheral walls, the operation body includes:

a second outer peripheral wall that surrounds an outer side of the first outer peripheral wall of the casing;

a second inner peripheral wall located further inside of the operation body than the second outer peripheral wall and located inside of the first inner peripheral wall of the casing;

a first engagement portion provided to an inner side of the second outer peripheral wall and slidably engaged with at least one first side of the first guide of the casing; and a second engagement portion provided to an outer side of the second inner peripheral wall and movable along the second guide of the casing in accordance with sliding of the first engagement portion with the at least one first side of the first guide of the casing, and a clearance between the second guide of the casing and the second engagement portion of the operation body is smaller than a clearance between a second side of the first guide of the casing and the first engagement portion of the operation body.

2. The push switch according to claim 1, further comprising a first light source housed in the casing and surrounded by the first inner peripheral, wherein the first light source illuminates the operation body so as to penetrate the operation body with an emitting light.

3. The push switch according to claim 2, further comprising a light guide element fitted in a space defined by the second inner peripheral wall, and having an end opposed to the first light source.

4. The push switch according to claim 2, further comprising a second light source housed in the casing, wherein the second light source illuminates the operation body together with the first light source so as to penetrate the operation body with an emitting light, the first light source is opposed to a region surrounded by the second inner peripheral wall; and the second light source is optically isolated from the first light source by one of the pair of first inner peripheral walls and the second inner peripheral wall.

5. The push switch according to claim 1, wherein the second guide and the second engagement portion are formed as ribs and are opposed to each other.

6. The push switch according to claim 1, wherein the casing further includes a base on which the first outer peripheral wall and the pair of first inner peripheral walls stand, the second guide extends from the base of the casing in a direction in which the operation body is movable, at least one of the second guide and the second engagement portion is configured to be coated with a lubricant agent, and the base of the casing is provided with a recess in a periphery of the second guide.

7. The push switch according to claim 1, wherein the first outer peripheral wall of the casing has an approximate rectangular shape of greater length in a horizontal direction than width in a front-to-back direction, the second guide is one of a plurality of second guides, the pair of first inner peripheral walls is provided with the plurality of second guides, and two of the plurality of second guides are located in a longitudinal direction of the casing.

8. The push switch according to claim 1, wherein at least one of the second guide of the casing and the second engagement portion of the operation body includes a groove, and at least one side of the second guide of the casing is slidably engaged with at least one side of the second engagement portion of the operation body.

9. The push switch according to claim 1, wherein at least one of the first guide of the casing and the first engagement portion of the operation body includes a groove, and the at least one first side of the first guide of the casing is slidably engaged with at least one side of the first engagement portion of the operation body.

* * * * *